US011676784B2

(12) United States Patent
Baron et al.

(10) Patent No.: US 11,676,784 B2
(45) Date of Patent: Jun. 13, 2023

(54) VACUUM INTERRUPTER

(71) Applicant: SIEMENS ENERGY GLOBAL GMBH & CO. KG, Munich (DE)

(72) Inventors: Lydia Baron, Dallgow-Doeberitz (DE); Frank Graskowski, Wandlitz (DE); Uwe Jahnke, Berlin (DE); Christian Stiehler, Berlin (DE); Andreas Lawall, Berlin (DE); Klaus Schachtschneider, Berlin (DE)

(73) Assignee: Siemens Energy Global GmbH & Co. KG, Munich (DE)

( * ) Notice: Subject to any disclaimer, the term of this patent is extended or adjusted under 35 U.S.C. 154(b) by 0 days.

(21) Appl. No.: 16/771,801

(22) PCT Filed: Nov. 20, 2018

(86) PCT No.: PCT/EP2018/081927
§ 371 (c)(1),
(2) Date: Jun. 11, 2020

(87) PCT Pub. No.: WO2019/115178
PCT Pub. Date: Jun. 20, 2019

(65) Prior Publication Data

US 2021/0074494 A1 Mar. 11, 2021

(30) Foreign Application Priority Data

Dec. 11, 2017 (DE) ..... 102017222406

(51) Int. Cl.
*H01H 33/662* (2006.01)
*H01H 33/664* (2006.01)

(52) U.S. Cl.
CPC .... *H01H 33/66238* (2013.01); *H01H 33/664* (2013.01)

(58) Field of Classification Search
CPC ..... H01H 33/66238; H01H 33/664; H01H 2033/66246; H01H 2033/66253;
(Continued)

(56) References Cited

U.S. PATENT DOCUMENTS 2,981,813 A * 4/1961 Jennings ..... H01H 33/66 218/124
3,178,542 A * 4/1965 Jennings ..... H01H 33/66261 218/118

(Continued)

FOREIGN PATENT DOCUMENTS

CN 1056184 A 11/1991
CN 103531398 A 1/2014

(Continued)

OTHER PUBLICATIONS

Translation of JP2004-241373 (Original document published Aug. 26, 2004) (Year: 2004).*

(Continued)

*Primary Examiner* — William A Bolton
(74) *Attorney, Agent, or Firm* — Laurence A. Greenberg; Werner H. Stemer; Ralph E. Locher

(57) ABSTRACT

A vacuum interrupter includes at least one insulating body, a fixed contact, a fixed contact flange, a moving contact having a longitudinal axis of the moving contact, a moving contact flange, a moving contact bearing, and a bellows. The fixed contact is stationarily disposed in the fixed contact flange, the moving contact is moveably guided in the moving contact bearing and the moving contact is moveably secured to the moving contact flange by the bellows. The bellows is secured to the moving contact flange by a first bellows end and the bellows is secured to the moving contact by a second bellows end. An increased pressure resistance of the vacuum interrupter against ambient pressures over 1 bar is achieved by a sleeve which is secured to the moving (Continued)

contact against movements along the longitudinal axis of the moving contact, and which is guided through the moving contact bearing.

10 Claims, 3 Drawing Sheets

(58) Field of Classification Search
CPC ..... H01H 9/041; H01H 3/32; H01H 2033/66223; H01H 33/66207
USPC ..... 218/118, 123, 124, 134, 135, 139, 146, 218/136
See application file for complete search history.

(56) References Cited

U.S. PATENT DOCUMENTS

| | | | | | |
|---|---|---|---|---|---|
| 3,231,704 | A | * | 1/1966 | Jacobs | H01H 33/66207 218/136 |
| 3,539,747 | A | * | 11/1970 | Alexander | F16J 3/046 218/135 |
| 4,039,792 | A | * | 8/1977 | Crouch | H01H 33/66207 218/128 |
| 4,492,837 | A | | 1/1985 | Crouch et al. | |
| 5,155,314 | A | | 10/1992 | Dufoumet et al. | |
| 5,510,592 | A | * | 4/1996 | Gentsch | H01H 33/66238 218/134 |
| 5,543,598 | A | | 8/1996 | Deffour et al. | |
| 6,163,002 | A | * | 12/2000 | Ahn | H01H 33/6643 218/123 |
| 6,506,992 | B2 | * | 1/2003 | Kim | H01H 33/6644 218/123 |
| 6,649,856 | B2 | * | 11/2003 | Makino | H01B 17/50 218/118 |
| 7,173,208 | B2 | * | 2/2007 | Harada | H01H 33/6644 218/118 |
| 9,478,376 | B2 | * | 10/2016 | Miki | H01H 33/66238 |
| 10,553,377 | B2 | | 2/2020 | Binner et al. | |
| 2002/0153353 | A1 | * | 10/2002 | Inagaki | H01H 33/664 218/118 |

FOREIGN PATENT DOCUMENTS

| | | | | | |
|---|---|---|---|---|---|
| CN | 205248178 | U | | 5/2016 | |
| DE | 112011105304 | T5 | | 3/2014 | |
| DE | 102016002261 | A1 | | 8/2017 | |
| EP | 0641001 | A1 | | 3/1995 | |
| JP | S52137073 | U | | 10/1977 | |
| JP | S5324465 | U | | 3/1978 | |
| JP | S5828119 | | * | 2/1983 | ... H01H 2033/66246 |
| JP | S59209230 | A | | 11/1984 | |
| JP | S6289740 | U | | 6/1987 | |
| JP | 2004241373 | | * | 8/2004 | ... H01H 2033/66246 |
| JP | 2005339865 | A | | 12/2005 | |
| JP | 2011054504 | A | | 3/2011 | |
| WO | 2012164659 | A1 | | 12/2012 | |

OTHER PUBLICATIONS

Translation of JPS 5828119 (original document published Feb. 19, 1983) (Year: 1983).*
Translation of JP2011054504 (original document published Mar. 17, 2011) (Year: 2011).*
JP2005-339865 (Original document published Dec. 8, 2005) (Year: 2005).*

* cited by examiner

VACUUM INTERRUPTER

BACKGROUND OF THE INVENTION

Field of the Invention

The invention relates to a vacuum interrupter tube for medium-voltage switchgear and high-voltage installations.

Vacuum interrupters from the prior art have a bellows for movably guiding the moving contact of the vacuum interrupter into the vacuum interrupter.

For large strokes and/or long bellows, the problem arises, especially at ambient pressures above one bar (1 bar), that the bellows undergoes deformation during switching operations, for example kinking and/or bending and/or twisting and rubbing against the moving contact. This reduces the service life of the bellows, and thus that of the vacuum interrupter.

SUMMARY OF THE INVENTION

The object of the invention is therefore to reduce or prevent deformation of the bellows and friction of the bellows against the moving contact.

The object is achieved by the independent claim as described below and by the claims dependent on it.

In an exemplary embodiment, the vacuum interrupter has at least one insulating body, a fixed contact, a fixed-contact flange, a moving contact having a longitudinal axis of the moving contact, a moving-contact flange, a moving-contact bearing, and a bellows. The fixed contact is arranged in a stationary manner in the fixed-contact flange, the moving contact is movably guided in the moving-contact bearing, and the moving contact is movably fastened to the moving-contact flange by the bellows, wherein the bellows is fastened to the moving-contact flange by a first bellows end, and the bellows is fastened to the moving contact by a second bellows end, wherein an increased pressure resistance of the vacuum interrupter against ambient pressures over 1 bar is achieved by a sleeve that is fixed on the moving contact, against movements along the longitudinal axis of the moving contact, and that is passed through the moving-contact bearing. In particular, an increased pressure resistance of the vacuum interrupter against ambient pressures over 2 bar, particularly preferably over 4 bar, is also achieved.

The fixing of the sleeve on the moving contact has the effect in this case that the bellows is protected in every switch position, and that there is no possibility of frictional contact between the bellows and the moving contact, or of deformation of the bellows, even when the contact system consisting of the fixed contact and moving contact is closed. This also results in a longer service life at increased ambient pressures. Increased ambient pressures in this case occur, preferably, when the vacuum interrupter is arranged in a pressurized gas, in particular an insulating gas, particularly preferably a gas having a GWP (Global Warming Potential) lower than that of SF6. In particular, the gas with which the switchgear is filled may be a ketone, in particular a fluoroketone, a nitrile, or a gas mixture comprising nitrogen and carbon dioxide.

The sleeve in this case is preferably designed such that it has an inner contour that emulates the outer contour of the moving contact in the region in which the sleeve is fastened on the moving contact.

In an advantageous embodiment, the sleeve is also designed such that, in the assembled state, the distance between the sleeve and the bellows is small.

It is also preferred that the sleeve be arranged on the moving contact in such a manner that the sleeve extends out from the second bellows and through the moving-contact bearing, and the sleeve be fixed on the moving contact, by means of a fastening means, in such a manner that, during the movement of the moving contact, no relative movement along the longitudinal axis of the moving contact occurs between the moving contact and the sleeve.

It is also preferred that the moving contact have at least one moving-contact rod and one moving-contact contact disk, and the second bellows end is directly connected to the moving-contact rod. There may also be a moving-contact body arranged between the moving-contact rod and the moving-contact disk.

It is additionally preferred that the moving contact have at least one moving-contact rod and one moving-contact contact disk, and the second bellows end be connected to the moving-contact rod via a bellows cap. There may also be moving-contact body arranged between the moving-contact rod and the moving-contact disk.

It is also preferred that the sleeve be fixed in position on the moving contact, in the region of the second bellows end and/or in the region of the bellows cap, by means of an press fit. Alternatively, the sleeve is fastened by latching, interlocking, soldering, welding, pressing to a thickened portion of the moving contact that is not emulated by the sleeve, or by other means.

It is also preferred, in particular, that the press fit of the sleeve be effected between the second bellows end and the moving contact, or between the bellows cap and the moving-contact rod. In particular, the sleeve may additionally be interlocked with structural elements at the second bellows end, on the moving contact or on the bellows cap. In particular, projections and/or recesses that engage in each other are suitable for interlocking.

It is also preferred that the moving-contact bearing have a first guide element and the sleeve have a second guide element, wherein the first guide element and the second guide element engage in each other in such a manner that the sleeve is prevented from rotating in the moving-contact bearing. In particular, tongue and groove structures that engage in each other are suitable, i.e. the first guide element is, for example, a groove and the second guide element is, for example, a protruding structural element, a groove engagement, such as a tongue, or vice versa. The structural element in this case may be either fixed, inflexible or flexible. The combined action of the first guide element and the second guide element thus prevents the sleeve from rotating in the moving-contact bearing.

It is further preferred that the sleeve have more than one first guide element, in particular two or three first guide elements, and that the moving-contact bearing have more than one second guide element, in particular two or three second guide elements. The respectively corresponding guide elements in this case engage in each other, i.e. in each case one first guide element and one second guide element act in combination, such that two, three or more first guide elements and second guide elements provide reliable guiding, and thus effective protection against relative rotation between the moving-contact bearing and the sleeve.

It is also preferred that the first guide element and the second guide element engage in each other and mutually limit their movement in such a manner that the sleeve does not slide out of the moving-contact bearing. For example, this is possible by delimitation of the groove in its longitudinal extent, parallel to the longitudinal axis of the moving contact, i.e. in this example, the groove engagement, e.g. a tongue, abuts the end of the groove and thus does not allow any further movement of the sleeve and of the moving contact connected to the sleeve. It is thereby possible to prevent the bellows from being overstretched, for example during transport, as a result of overstretching in the case of the sleeve, with the moving contact, slipping out of the moving-contact bearing, since the movement is delimited by the first guide element and the second guide element.

The sleeve thus renders possible not only a reduced risk of deformation and, consequently, higher ambient pressures and/or greater bellows strokes and lengths, but also protection against damage to the bellows due to overstretching of the bellows.

It is also preferred that the moving contact rod have a third guide element, and the sleeve have a fourth guide element, which act in combination in such a manner that rotation of the sleeve on the moving-contact rod is prevented.

In particular, it is preferred that the third guide element be formed by a flattened portion on the circumference of the moving-contact rod, in particular of the moving contact, and that the fourth guide element be formed by a raised flattened portion in the sleeve that correspondingly fills up the region having the flattened portion of the moving-contact rod or the moving contact. Alternatively, the moving-contact rod may also have, wholly or partially, an elliptical circumferential profile, an elliptical cross-sectional face, and the sleeve may have an elliptical circumferential profile, an elliptical cross-sectional face.

It is further preferred that the moving-contact rod have more than one third guide element, in particular two or three third guide elements, and that the sleeve have more than one fourth guide element, in particular two or three fourth guide elements. The respectively corresponding guide elements in this case engage in each other, i.e. in each case one third guide element and one fourth guide element act in combination, such that two, three or more third guide elements and fourth guide elements provide reliable guiding, and thus effective protection against relative rotation between the moving-contact and the sleeve.

Owing to the use of the first guide element, the second guide element, the third guide element and the fourth guide element, or multiples of these, the risk of deformation with respect to torsion of the bellows is also reduced, in addition to the reduction of the risk of deformation of the bellows by the sleeve.

It is also preferred that the sleeve be composed of a material that has a low coefficient of friction. In particular, it is preferred that the coefficient of friction for static friction and the coefficient of friction for sliding friction are both low and, particularly preferably, that the coefficients of friction for static friction and sliding friction are the same, which also enables smooth sliding and stopping.

It is additionally preferred that the sleeve be composed of polytetrafluoroethylene or of a modification of polytetrafluoroethylene, i.e. a chemically related material.

It is also advantageous if the second bellows end and/or the bellows cap are/is additionally provided with a bellows shield. The bellows shield in this case prevents and/or reduces deposition of evaporated material on the bellows.

It is also preferred that the bellows shield extend from the second bellows end toward the moving-contact flange.

The invention is explained in the following on the basis of the figures.

DETAILED DESCRIPTION OF THE INVENTION

Figure 1:
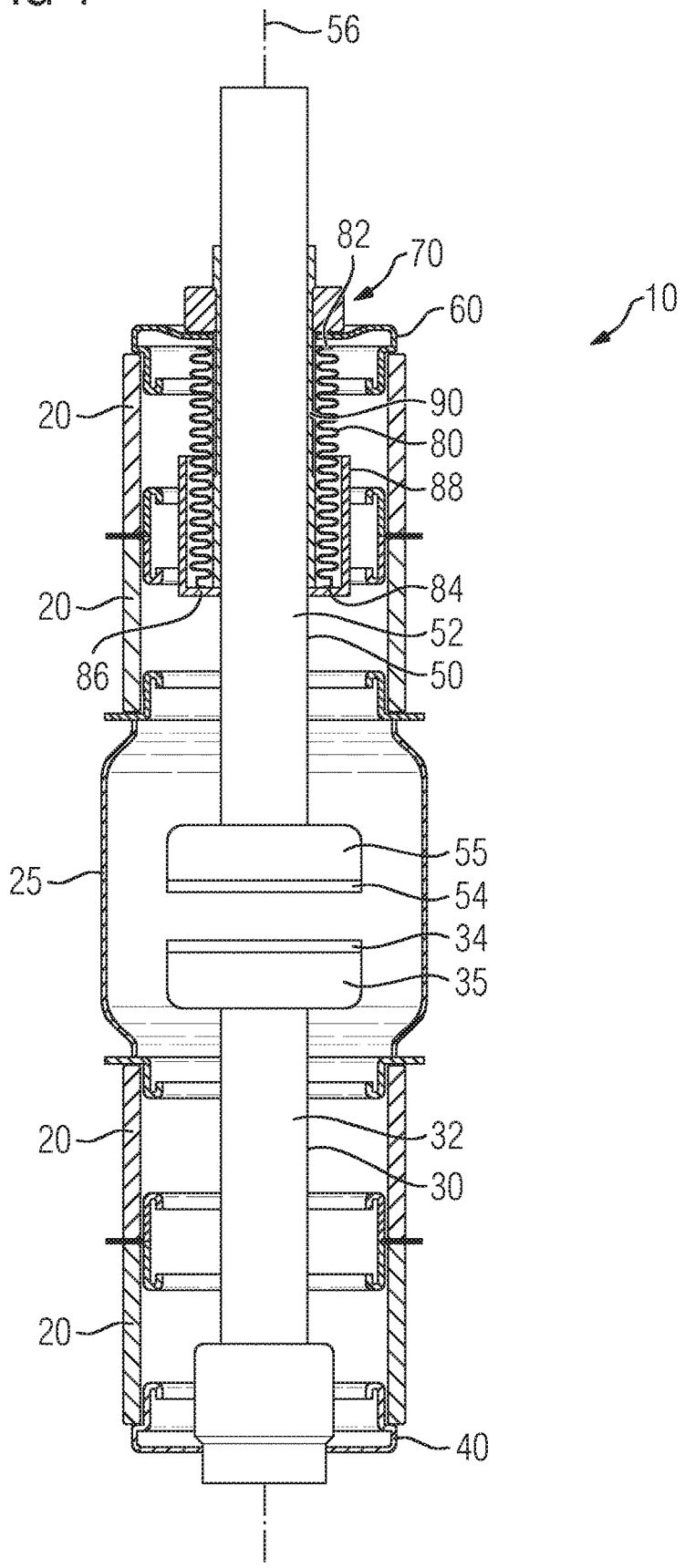
FIG. 1: section through a vacuum interrupter with a sleeve according to the invention.

FIG. 1 shows a section through a vacuum interrupter 10 having a sleeve 90 according to the invention. The vacuum interrupter 10 in this case has insulating elements 20, which in this case, optionally, are spaced apart in the region of the contact disks by an intermediate element 25.

The vacuum interrupter 10 additionally has a fixed contact 30, in this case consisting of a fixed-contact rod 32, a fixed-contact body 35 and a fixed-contact disk 34. The fixed contact 30 is fastened at one end of the vacuum interrupter 10, by means of a fixed-contact flange 40, to an insulating body 20.

A moving contact 50 of the vacuum interrupter 10 is disposed opposite the fixed contact 30, the moving contact 50 in this case consisting, as an example, of a moving-contact rod 52, a moving-contact body 55 and a moving-contact contact disk 54.

Fastened on the moving contact 50, or more precisely, on the moving-contact rod 52, there is a sleeve 90, and this sleeve 90 is extended out from the bellows through a moving-contact bearing 70 on the moving-contact flange 60. In the example shown here, the sleeve 90 is pressed tightly between the moving-contact rod 52 and the bellows cap 86. The sleeve 90 is thus fixed on the moving contact 52 in such a manner that there is no relative movement between the sleeve 90 and the moving contact 50 as the moving contact 50 moves along the longitudinal axis 56 of the moving contact 50. The bellows 80, which enables the moving contact 50 to move within the vacuum interrupter 10, is fastened to the moving-contact flange 60 by a first end 82 of the bellows 80. In FIG. 1, the second end 84 of the bellows 80 is fastened to the bellows cap 86, and the bellows cap 86 is in turn fastened to the moving-contact rod 52 of the moving contact 50. In FIG. 1, the bellows cap 86 has an optional bellows shield 88, which extends from the bellows cap 86, along the bellows 80, toward the moving-contact flange 60.

Figure 2:
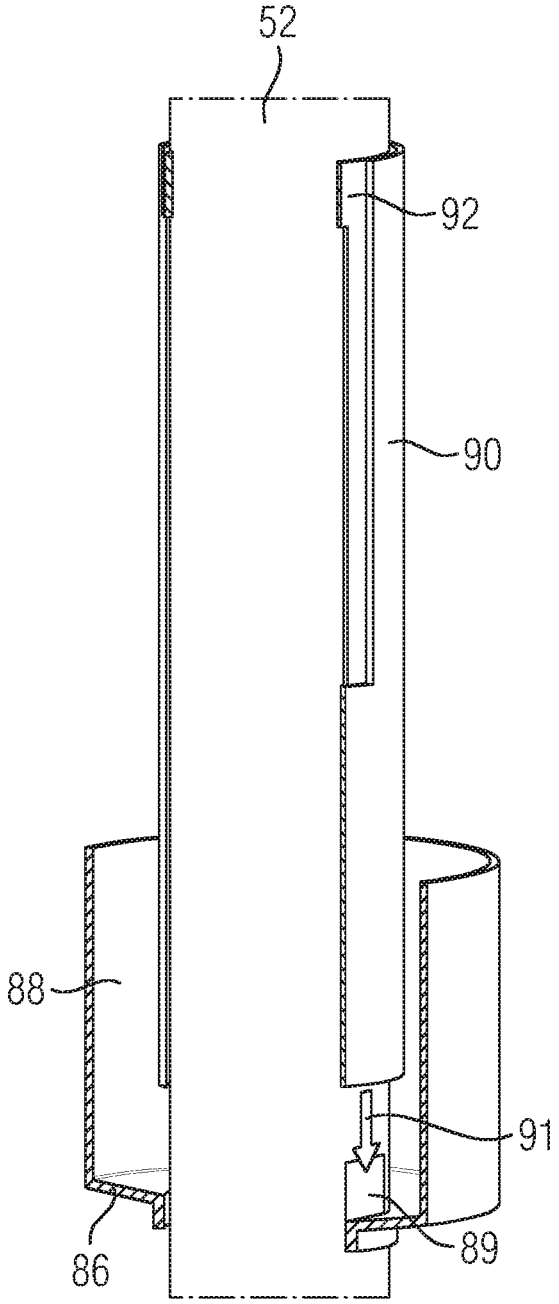
FIG. 2: section through a moving-contact rod with a sleeve and a bellows cap with a bellows shield.

FIG. 2 shows a moving-contact rod 52, with a sleeve 90, which is pressed into the press-in region 89 between the moving-contact rod 52 and the bellows cap 86, in the direction of the arrow 91. Optionally, this press-in region 89 may also be formed by a thickened portion of the moving-contact rod. In addition, the bellows cap 86 has a bellows shield 88, as shown in FIG. 1.

Figure 3:
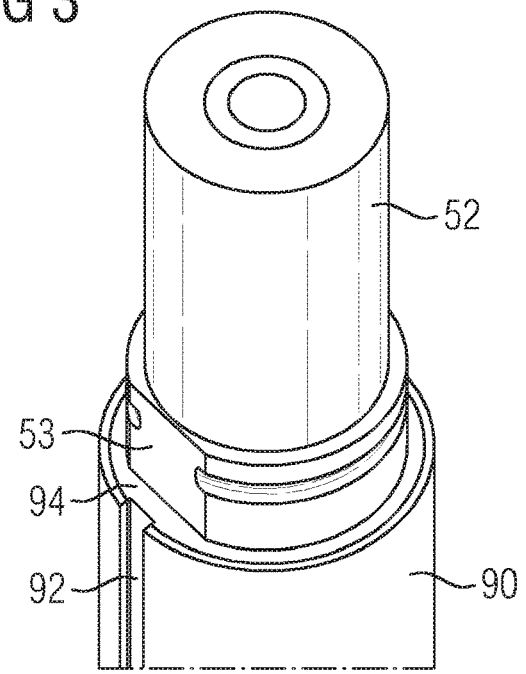
FIG. 3: perspective view of a guided sleeve in a moving-contact bearing.
Figure 4:
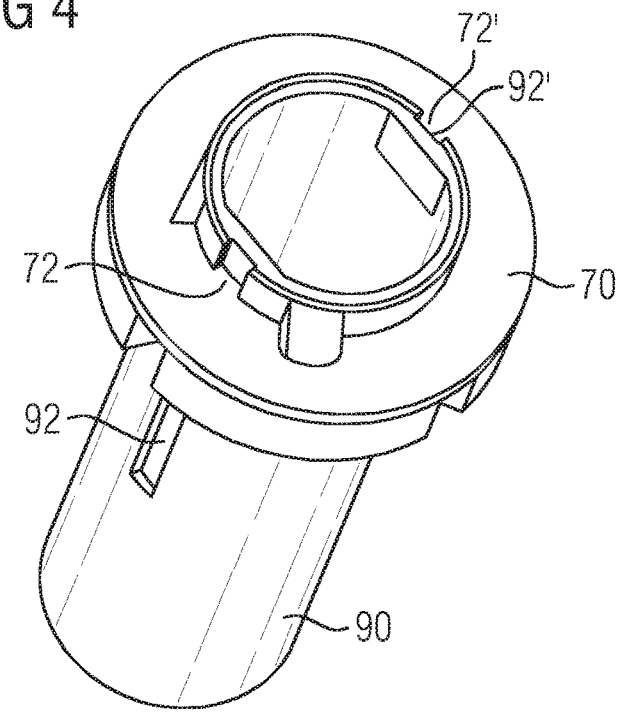
FIG. 4: perspective representation of a moving contact with a sleeve and guide elements.

FIG. 3 shows a portion of a moving-contact rod 52 with a third guide element 53, a sleeve 90 with a fourth guide element 94, and with a second guide element 92 in the sleeve 90 that acts in combination with the first guide element 72 of the moving-contact bearing 70, which is not shown here, but which is shown in FIG. 4.

FIG. 4 shows a sleeve 90 in a moving-contact bearing 70, the sleeve 90 having two second guide elements 92, 92', and the moving-contact bearing 70 having two corresponding first guide elements 72, 72'. The first guide elements 72, 72' in this case are realized as groove engagements, i.e. fixed structural elements. The second guide elements 92, 92' in this example are realized as a groove. The groove 92 in this case extents over the entire length of the sleeve 90, but is delimited at one end, thereby preventing the sleeve 90 and the moving contact 50, not shown, that is connected to the sleeve 90 from slipping through the moving-contact bearing 70.

LIST OF REFERENCES

10 vacuum interrupter
20 insulating body
25 intermediate element
30 fixed contact
32 fixed-contact rod
34 fixed-contact contact disk
35 fixed-contact body
40 fixed-contact flange
50 moving contact
52 moving-contact rod
53 third guide element
54 moving-contact contact disk
55 moving-contact bearing
56 longitudinal axis of the moving contact
60 moving-contact flange
70 moving-contact bearing
72 first guide element
72' further first guide element
80 bellows
82 first bellows end
84 second bellows end
86 bellows cap
88 bellows shield
89 press-in region
90 sleeve
91 arrow for the direction of pressing-in of the sleeve
90
92 second guide element
92' further second guide element
94 fourth guide element

The invention claimed is:

1. A vacuum interrupter, comprising:

at least one insulating body;

a fixed-contact flange;

a fixed contact disposed in a stationary manner in said fixed-contact flange;

a moving-contact bearing;

a moving contact having a moving-contact contact disk, a moving-contact rod and a longitudinal axis, said moving contact being movably guided in said moving-contact bearing;

a moving-contact flange;

a bellows having a first bellows end, a second bellows end and a bellows cap, said bellows cap connecting said second bellows end to said moving-contact rod, said bellows movably fastening said moving contact to said moving-contact flange by fastening said first bellows end to said moving-contact flange and fastening said second bellows end to said moving contact;

said moving-contact bearing disposed outside of said bellows;

a sleeve providing an increased pressure resistance of the vacuum interrupter against ambient pressures over 1 bar, said sleeve being fixed on said moving contact against movements between said sleeve and said moving contact along said longitudinal axis of said moving contact and said sleeve passing through said moving-contact bearing, said sleeve extending out from said first bellows end through said moving-contact bearing;

said moving contact having a thickened portion not present at said sleeve;

said sleeve being fixed in position on said moving contact in at least one of a region of said second bellows end or a region of said bellows cap by a press fit, latching, interlocking, soldering or welding of said thickened portion, and said press fit of said sleeve being provided between said second bellows end and said moving contact or between said bellows cap and said moving contact rod; and a fastening device fixing said sleeve on said moving contact and preventing relative movement along said longitudinal axis of said moving contact between said moving contact and said sleeve during movement of said moving contact;

said moving-contact rod and said bellows cap defining a press-in region therebetween, and said sleeve being pressed into said press-in region.

2. The vacuum interrupter according to claim 1, wherein said moving-contact rod is at least one moving-contact rod, said moving contact has at least one moving-contact contact disk, and said second bellows end is directly connected to said at least one moving-contact rod.

3. The vacuum interrupter according to claim 1, wherein said moving-contact bearing has at least one first guide element, said sleeve has at least one second guide element, and said first guide element and said second guide element engage in each other to prevent said sleeve from rotating in said moving-contact bearing.

4. The vacuum interrupter according to claim 3, wherein said first guide element and said second guide element engaging in each other mutually limit their movement to prevent said sleeve from sliding out of said moving-contact bearing.

5. The vacuum interrupter according to claim 3, wherein said moving-contact rod has at least one third guide element, and said sleeve has at least one fourth guide element acting in combination to prevent rotation of said sleeve on said moving-contact rod.

6. The vacuum interrupter according to claim 1, wherein said sleeve is composed of a material having a coefficient of friction being low enough to enable smooth sliding and stopping.

7. The vacuum interrupter according to claim 1, wherein said sleeve is composed of polytetrafluoroethylene or of a modification of polytetrafluoroethylene.

8. The vacuum interrupter according to claim 1, wherein at least one of said second bellows end or said bellows cap has a bellows shield.

9. The vacuum interrupter according to claim 8, wherein said bellows shield extends from said second bellows end toward said moving-contact flange.

10. The vacuum interrupter according to claim 1, wherein said sleeve is disposed directly on said moving contact over an entire surface of said sleeve.

* * * * *